United States Patent [19]

Gould

[11] Patent Number: 4,482,027

[45] Date of Patent: Nov. 13, 1984

[54] ACOUSTIC TRAP FOR DISCHARGING FIRE ARMS

[76] Inventor: William A. Gould, 486 14th St., Brooklyn, N.Y. 11215

[21] Appl. No.: 527,570

[22] Filed: Aug. 29, 1983

[51] Int. Cl.[3] ..... F41C 21/08; F41F 17/12

[52] U.S. Cl. ..... 181/223

[58] Field of Search ..... 181/223, 256, 258; 89/14 D, 14 E

[56] References Cited

U.S. PATENT DOCUMENTS 2,448,382 8/1948 Mason ..... 181/256

4,082,160 4/1978 Schilling et al. ..... 181/256

*Primary Examiner*—Michael L. Gellner

*Assistant Examiner*—Brian W. Brown

*Attorney, Agent, or Firm*—Richard L. Miller

[57] ABSTRACT

An acoustic trap for discharging fire arms is provided and consists of an elongated sealed chamber, a support for placing the chamber in an angular downward position so that a barrel of the fire arm can discharge a bullet within the chamber and material for reducing noise level within the chamber.

7 Claims, 3 Drawing Figures

ACOUSTIC TRAP FOR DISCHARGING FIRE ARMS

BACKGROUND OF THE INVENTION

The instant invention relates generally to fire arms and more specifically it relates to an acoustic trap for discharging fire arms.

When a person wants to test fire arm actions in a safe way they must discharge the fire arm at a firing range or outdoors in an open field. This situation is not desirable so accordingly it is in need of an improvement.

SUMMARY OF THE INVENTION

A principle object of the present invention is to provide an acoustic trap for discharging fire arms that will pulverize a bullet within a chamber.

Another object is to provide an acoustic trap for discharging fire arms that will reduce noise level within the chamber.

An additional object is to provide an acoustic trap for discharging fire arms that will confine the discharged dust within the chamber.

A further object is to provide an acoustic trap for discharging fire arms that is simple and easy to use.

A still further object is to provide an acoustic trap for discharging fire arms that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
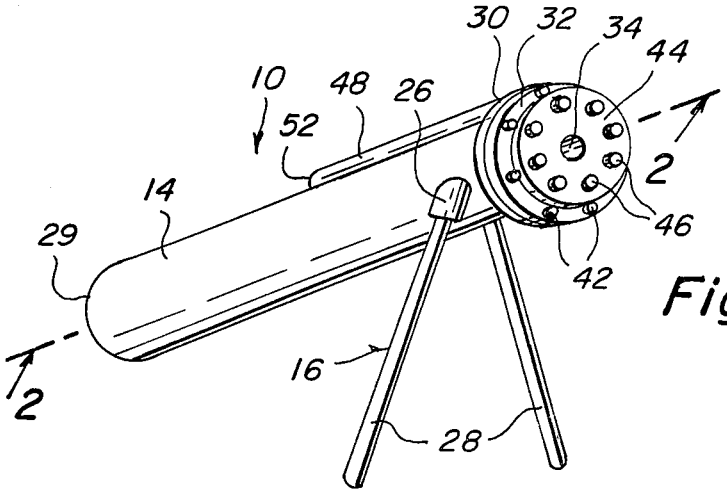
FIG. 1 is a perspective view of the invention.
Figure 2:
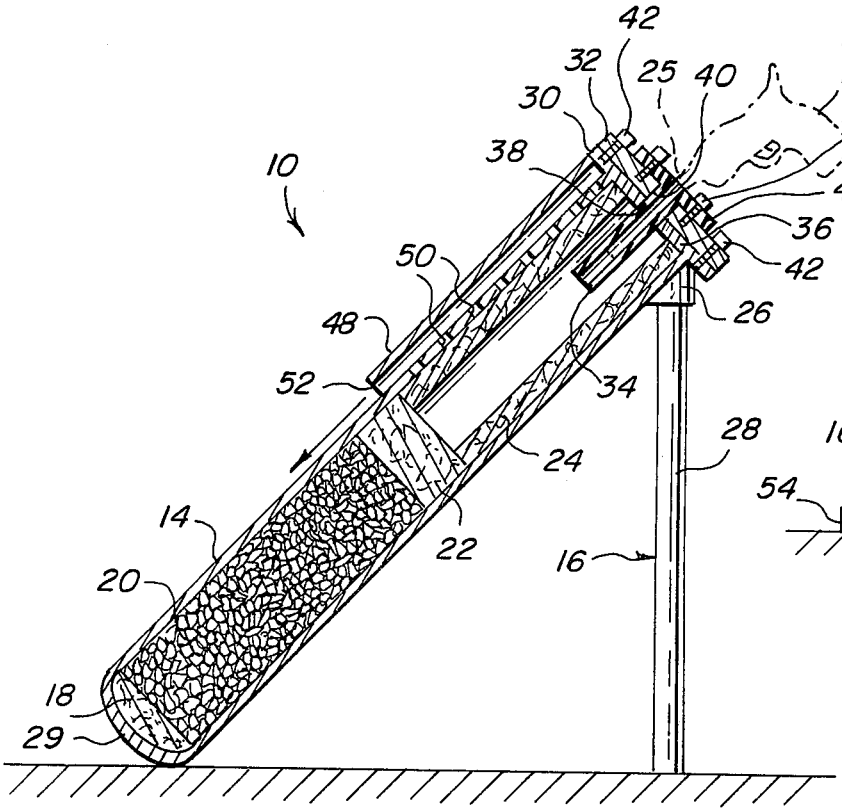
FIG. 2 is across sectional view taken on line 2—2 in FIG. 1.

Turning now descriptively to the drawings, in which similar reference characters denote similar elements throughout the several views, FIGS. 1 and 2 illustrates an acoustic trap 10 for discharging fire arms 12. The trap consists of an elongated sealed chamber 14, a support 16, a layer of fiberglass insulation 18, a layer of fine gravel 20, another layer of fiberglass insulation 22 and a fiberglass insulation sleeve 24.

The support 16 is for placing the chamber 14 in a forty five degree angular downward position so that a barrel 25 of the fire arm 12 can discharge a bullet (not shown) within the chamber 14. The support 16 consists of a pair of leg holders 26 and a pair of legs 28. Each leg holder 26 is affixed to upper portion of the chamber 14 while each leg 28 is affixed within each leg holder 26.

The layer of fiberglass insulation 18 is placed at bottom 29 of the chamber 14 while the layer of fine gravel 20 is placed over the layer of fiberglass insulation 18.

Both the fiberglass insulation 18 and the layer of fine gravel are for pulverizing the bullet within the chamber 14.

The other layer of fiberglass insulation 22 is placed over the layer of fine gravel 20 while the fiberglass insulation sleeve 24 is placed over the layer of fiberglass insulation 22. Both the fiberglass insulation 22 and the fiberglass insulation sleeve 24 are for reducing noise level within the chamber.

The trap 10 further consists of an annular flange 30, an end cap 32 and a hollow rubber tube 34. The annular flange 30 is formed at upper end 36 of the chamber 14. The upper end has a central aperture 38 therethrough. The end cap 32 has a central aperture 40 therethrough. The end cap 32 is secured to the annular flange 30 by bolts 42.

The hollow rubber tube 34 has an annular flat end 44. The hollow rubber tube 34 is inserted through the central aperture 40 of the end cap 32 and central aperture 38 in upper end 36 of the chamber 14. The annular flat end 44 is secured to the end cap 32 by bolts 46. The barrel 25 of the fire arm 12 can be inserted within the chamber 14 confining the discharged dust within the chamber 14.

An elongated vent cover 48 is affixed to upper portion of outer wall of the chamber 14. The chamber 14 has a plurality of vent holes 50 so that discharged gases can be exhausted out of open end 52 of the elongated vent cover 48.

Figure 3:
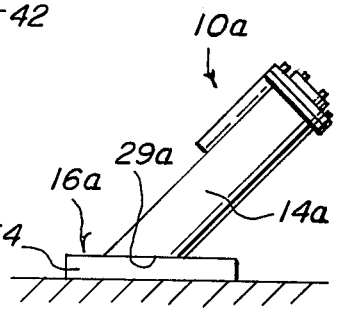
FIG. 3 is a side view of another embodiment of the invention.

FIG. 3 shows another support **16*a* for placing the chamber 14*a* in a forty five degree angular downward position. The support 16*a* consists of a weighted base plate 54 affixed to bevelled bottom 29*a* of the chamber 14*a***.

To operated the trap 10 or **10*a* a person places the barrel 25 of the fire arm 12 into the hollow rubber tube 34. When the bullet is discharged it will pass through the layer of fiberglass insulation 22 and enter the fine gravel 20** thus pulverizing the bullets so that testing of the fire arms actions can be accomplished.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An acoustic trap for discharging fire arms which comprises:

(a) an elongated sealed chamber;

(b) a support for placing said chamber in an angular downward position so that a barrel of the fire arm can discharge a bullet within said chamber;

(c) means for pulverizing the bullet within said chamber; and (d) means for reducing noise level within said chamber.

2. An acoustic trap for discharging fire arms as recited in claim 1 wherein said means for pulverizing the bullet within said chamber comprises:

(a) a layer of fiberglass insulation placed at bottom of said chamber; and (b) a layer of fine gravel placed over said layer of fiberglass insulation.

3. An acoustic trap for discharging fire arms as recited in claim 2 wherein said means for reducing noise level within said chamber comprises (a) a layer of fiberglass insulation placed over said layer of fine gravel; and (b) a fiberglass insulation sleeve placed over said layer of fiberglass insulation.

4. An acoustic trap for discharging fire arms as recited in claim 3 that further comprises:

(a) an annular flange formed at upper end of said chamber, the upper end having a ventral aperture therethrough (b) an end cap having a central aperture therethrough, said end cap secured to said annular flange, and (c) a hollow rubber tube having an annular flat end, said hollow rubber tube inserted through the central aperture of said end cap and central aperture in upper end of said chamber with the annular flat end secured to said end cap so that the the barrel of the fire arm can be inserted within said chamber confining the discharged dust within said chamber.

5. An acoustic trap for discharging fire arms as recited in claim 4 that further comprises an elongated vent cover affixed to upper portion of outer wall of said chamber, having a plurality of vent holes so that discharged gases can be exhausted out of open end elongated vent cover.

6. An acoustic trap for discharging fire arms as recited in claim 5 wherein said support for placing said chamber in an angular downward position comprises a weighted base plate affixed to bevelled bottom of said chamber.

7. An acoustic trap for discharging fire arms as recited in claim 5 wherein said support for placing said chamber in an angular downward position comprises:

(a) a pair of leg holders, each leg holder affixed to upper portion of said chamber, and (b) a pair of legs, each leg affixed within each said leg holder.

* * * * *